US010501296B2

(12) United States Patent
O'Keeffe

(10) Patent No.: US 10,501,296 B2
(45) Date of Patent: Dec. 10, 2019

(54) LINKAGE SYSTEM FOR A FORKLIFT TRUCK

(71) Applicant: PALFINGER AG, Bergheim (AT)

(72) Inventor: Eric O'Keeffe, Monaghan (IE)

(73) Assignee: PALFINGER AG (AT)

( * ) Notice: Subject to any disclaimer, the term of this patent is extended or adjusted under 35 U.S.C. 154(b) by 222 days.

(21) Appl. No.: 15/739,334

(22) PCT Filed: Jun. 29, 2016

(86) PCT No.: PCT/EP2016/065186
§ 371 (c)(1),
(2) Date: Dec. 22, 2017

(87) PCT Pub. No.: WO2017/001507
PCT Pub. Date: Jan. 5, 2017

(65) Prior Publication Data

US 2018/0179039 A1 Jun. 28, 2018

(30) Foreign Application Priority Data

Jun. 29, 2015 (IE) ..... S2015/0191
Jul. 16, 2015 (IE) ..... S2015/0203

(51) Int. Cl.
*B66F 9/12* (2006.01)
*B66F 9/14* (2006.01)

(52) U.S. Cl.
CPC ..... *B66F 9/122* (2013.01); *B66F 9/146* (2013.01)

(58) Field of Classification Search
CPC .. B66F 9/122; B66F 9/146; B66F 9/10; B66F 9/12; B66F 9/14; B66F 9/16; B60P 1/483; B60P 1/6427
(Continued)

(56) References Cited

U.S. PATENT DOCUMENTS 6,079,935 A 6/2000 Brunner et al. ..... 414/641
9,309,097 B2 4/2016 O'Keeffe ..... 414/667
(Continued)

FOREIGN PATENT DOCUMENTS

JP S48-38682 Y2 11/1973
WO WO 2015/177515 A1 11/2015

OTHER PUBLICATIONS

International Search Report dated Oct. 20, 2016 in corresponding PCT International Application No. PCT/EP2016/065186.
(Continued)

*Primary Examiner* — Glenn F Myers
(74) *Attorney, Agent, or Firm* — Ostrolenk Faber LLP

(57) ABSTRACT

A forklift linkage system (100) for movement has a levelling carriage assembly (110) movably contained within a channel assembly (120). A main long link pivotally connects to the levelling carriage assembly (110) at a first pivot point (111) and a fork carriage assembly (150) at a second pivot point (151). A short link (140) pivotally connects near a midpoint (131) of the main long link (130) at a third pivot point (121) and at a fixed pivot point (121) relative to the channel (120), near a vertical offset position from the pivot point of the main long link (130) to the levelling carriage assembly (110) at a fourth pivot point (112). A levelling link (160) pivotally connects to the levelling carriage assembly (110) at a fifth pivot point (151) and at the opposite end to a fork carriage assembly (150) at a sixth pivot point, such that the travel path of the second pivot point (151) connecting the main long link (130) to the fork carriage assembly (150) remains substantially perpendicular to the channel (120) when the linkage system (100) is moved between retracted and extended positions. The angle through the second pivot point (151) connects the main long link (130) to the fork carriage assembly (150). The sixth pivot point (152) connects the levelling link (160) to the fork carriage assembly (150)
(Continued)

substantially constant in relation to the channel (120) when the linkage system (100) is moved between retracted and extended positions.

25 Claims, 13 Drawing Sheets

(58) Field of Classification Search
USPC ..... 414/662, 663, 667, 664
See application file for complete search history.

(56) References Cited

U.S. PATENT DOCUMENTS

2010/0068023 A1* 3/2010 Kuck ..... B66F 9/08
414/663
2012/0171004 A1* 7/2012 Jones, Jr. ..... B66F 9/22
414/664
2012/0263565 A1* 10/2012 O'Keeffe ..... B66F 9/146
414/667

OTHER PUBLICATIONS

Written Opinion dated Oct. 20, 2016 in corresponding PCT International Application No. PCT/EP2016/065186.

* cited by examiner

LINKAGE SYSTEM FOR A FORKLIFT TRUCK

CROSS-REFERENCE TO RELATED APPLICATIONS

The present application is a 35 U.S.C. §§ 371 national phase conversion of PCT/EP2016/065186, filed Jun. 29, 2016, which claims priority to Irish Short-Term Patent Application Nos. S2015/0191 and S2015/0203, filed Jun. 29, 2015 and Jul. 16, 2015, respectively, the contents of which are incorporated herein by reference. The PCT International Application was published in the English language.

TECHNICAL FIELD

The present invention relates to an improved linkage system for a forklift truck.

BACKGROUND OF THE INVENTION

It is known to use forklift trucks to remove and place loads on surfaces of varying depths and heights. Such forklifts generally comprise a wheeled chassis on which is mounted an upright mast and means for carrying loads. Usually the means for carrying loads are in the form of L-shaped members such as forks or tines that are able to engage the load to be carried. For the purpose of this specification and unless otherwise noted explicitly, the terms load carrying means, forks or tines shall be used interchangeably to describe the means by which a forklift truck carries its load. It is also known that such forklift trucks can be adapted to be mounted on a carrying vehicle. These forklift trucks are conventionally known as 'truck mounted' forklifts or 'piggy-back' forklifts.

Conventional forklifts are rated for loads at a specific maximum weight when at a specified forward centre of gravity. The forklift and load are regarded as a unit that has a continually varying centre of gravity with every movement of the load. Accordingly, all forklift trucks have to be designed to provide enough counterbalance to counteract the tipping moment caused by lifting the specified rated load capacity for stacking. More importantly the forklift truck must also have enough counter-balancing weight for travelling mode where the dynamic forces experienced require greatly increased stability.

Conventional counterbalance forklifts carry extra counterbalance weight on the rear of the truck to ensure safe operation while stacking or travelling. However, truck mounted forklifts are generally of straddle frame construction which enables the load to be carried substantially between the front wheels during travelling mode. This greatly improves stability without the requirement for additional counterweight. However, straddle frame construction generally requires a reach system to enable the forks to engage the load especially on a trailer bed or raised platform.

Generally, reach systems comprise, for example, moving mast systems, telescopic forks or pantograph linkage arrangements. When the forks are in an extended position, the load capacity that can be borne by the forks is substantially reduced. This can be overcome with a combination of additional machine weight, extra counter weight and stabiliser or jack legs mounted in the front of the forklift. However, truck mounted forklifts must be of lightweight construction in order to ensure that they can be mounted on the carrying vehicle. It is therefore advantageous to employ means to increase forklift capacity without increasing the forklift weight.

A pantograph reach system and telescopic forks tilt from the mast or fork carriage. This results in a magnification of tilt moment as the reach of the forks is extended from the upright mast. The practical effect of this is increased tilt stresses and reduced control of the tilt function.

Further problems associated with both pantograph reach systems and telescopic forks are increased costs. Telescopic forks whilst being the most compact of the above three systems are an extremely expensive component for forklift trucks. The means by which the pantograph system operates requires a duplication of components, for example linkage pieces, channels, bearings and so forth to operate. Not only does this increase the cost of the forklift truck, it also creates additional weight that the forklift must counterbalance in order to operate effectively at extended reach. Furthermore the pantograph system forms a substantially increased overhang when the forklift is mounted on a carrying vehicle. This causes a problem due to strict road transport regulations for carrying vehicles such as trucks or lorries.

Each of the aforementioned problems is of increased importance when the forklift is required to reach across a trailer bed to offload a pallet without moving the forklift to the other side of the trailer. This is known as a double reach system. These systems normally comprise one or more of the aforementioned systems for examples, a combination of telescopic forks attached to a moving mast system, telescopic forks attached to a pantograph system or a pantograph system used in conjunction with a moving mast system.

Although this linkage system is mainly described in relation to truck mounted forklifts, conventional reach systems are also used for various warehouse forklifts and straddle trucks. In this application, regular pantograph reach systems are commonly used but do cause restriction when entering racking systems. This is especially evident on a double deep pantograph reach truck where loads must be accessed two deep in warehouse racking systems. These racking systems are generally built to maximise capacity and therefore use the minimum allowable spacing between racking shelves. This causes problems for conventional pantograph reach systems as another set of channels is mounted on the fork carriage and would therefore need much increased space between the shelves when accessing the inner pallet. For this reason manufacturers use a double pantograph system to keep the required height clearance down, however this comes with much increased cost, complexity, and load overhang. In addition, these systems are less rigid, have more moving parts and very much restrict visibility. However this application requires the fork carriage tilt angle to remain constant throughout the transition between fully retracted to fully extended which was a problem for previous low profile linkage system designs.

SUMMARY OF THE INVENTION

It is therefore an object of the present invention to provide a linkage system and stability roller system that are designed to overcome the aforementioned problems.

It is acknowledged that the term 'comprise' may, under varying jurisdictions be provided with either an exclusive or inclusive meaning. For the purpose of this specification, and unless otherwise noted explicitly, the term comprise shall have an inclusive meaning that it may be taken to mean an inclusion of not only the listed components it directly references, but also other non-specified components. Accordingly, the term 'comprise' is to be attributed with as broad an interpretation as possible within any given jurisdiction and this rationale should also be used when the terms 'comprised' and/or 'comprising' are used.

According to a first aspect of the invention there is provided a forklift linkage system for movement, comprising;

a levelling carriage assembly movably contained within a channel assembly;

a main long link pivotally connected to the levelling carriage assembly at a first pivot point and a fork carriage assembly at a second pivot point;

a short link pivotally connected substantially near a midpoint of the main long link at a third pivot point and at a fixed pivot point relative to the channel, substantially near a vertical offset position from the pivot point of the main long link to the levelling carriage assembly at a fourth pivot point;

a levelling link pivotally connected to the levelling carriage assembly at a fifth pivot point and at the opposite end to a fork carriage assembly at a sixth pivot point such that the travel path of the second pivot point connecting the main long link to the fork carriage assembly remains substantially perpendicular to the channel when the linkage system is moved between a retracted and extended position and the angle through the second pivot point connecting the main long link to the fork carriage assembly and the sixth pivot point connecting the levelling link to the fork carriage assembly remains substantially constant in relation to the channel when the linkage system is moved between a retracted and extended position.

The advantage of the linkage system of the invention is that it is able to control the angle of the movement of the fork carriage assembly in the second plane as reach is extended or retracted.

Movement of the linkage system is occasioned by the application of force to the linkage system. Optionally the force can be applied by an actuator.

Ideally one end of the actuator is pivotally connected to the main long link and the other end of the actuator is connected to a fixed location on the channel assembly. Alternatively the actuator can be pivotally connected to the levelling carriage assembly, channel assembly, main long link or short link or any combination thereof.

The force applied by the actuator becomes a translational movement in which the actuator forces the levelling carriage assembly to move in a first plane within the channel, thereby moving the main long link and consequently forcing the fork carriage assembly to move along a second plane which is substantially perpendicular to the first plane. It is understood that any number of actuators can be used as required by the person skilled in the art.

Optionally in a further aspect of the invention, the levelling link means of the linkage system is a link arm or either a hydraulic or electrical ram which enables the linkage mechanism to provide an independent tilt mechanism. It is of course understood that the levelling link of the linkage system is not limited to this type of independent tilt mechanism any suitable means to achieve an independent tilt known to a person skilled in the art can also be used. In operation the fork carriage assembly will pivot about the pivot point connecting the main long link. In this way the reach of the load carrying means is extended without magnification of the tilt moment as the reach is extended from the upright fork mast. This enables the linkage system to compensate for a load's tendency to angle the load carrying means toward the ground, which in turn reduces the risk of slippage of a load from the load carrying means.

In a further aspect of the invention, the distance between the pivot points on the main long link, that is, the distance between the pivot point connecting the levelling carriage assembly to the main long link and the pivot point connecting the short link to the main long link is substantially equal to the distance between the pivot point connecting the short link to the main long link and the fork carriage assembly to the main long link are substantially equal.

In a further aspect of the invention, the distance between the pivot point connecting the short link to the main long link and the pivot point connecting the short link to the channel assembly is substantially equal to either of the distances between the pivot point connecting the levelling carriage assembly to the main long link and the pivot point connecting the short link to the main long link or the pivot point connecting the short link to the main long link and the fork carriage assembly to the main long link. Additionally, the pivot point connecting the levelling carriage assembly to the main long link and the pivot point connecting the main long link to the fork carriage assembly is substantially equal to the pivot point connecting the levelling link to the fork carriage and the pivot point connecting the levelling link to the levelling carriage assembly. Similarly, the distance between and orientation of the two pivot points connecting the links on the fork carriage assembly are substantially similar to those connecting the links on the levelling carriage assembly.

In a further aspect of the invention, the linkage system of the invention is adapted for use with a material handling device. Ideally in this aspect of the invention a load carrying means is attached to the fork carriage assembly of the linkage system. Optionally, the fork carriage assembly comprises at least one component to which the main long link and levelling link are pivotally connected. It is of course understood that fork carriage assembly can comprise any number of components suitable to achieve this purpose.

In a further aspect of the invention the actuator comprises a rod or a hydraulic or electrical ram. It is of course understood that any other type of suitable actuator known to the person skilled in the art could also be employed for this purpose.

In a further aspect of the invention, the levelling carriage assembly comprises components that are movable between a first and second position within the channel assembly. For example such components include a sliding mechanism or a rolling component. It is of course understood that any other type of suitable component known to the person skilled in the art could also be employed for this purpose.

In a further embodiment of the invention, the channel assembly is movably or slidably attached to an upright member such as an upright mast of a forklift truck.

In a further aspect of the invention, there is provided a forklift truck provided with the linkage system of the invention. Conveniently, the forklift truck is adapted to be mounted on a carrying vehicle. Ideally in this aspect of the invention, the load carrying means comprises a fork carriage and forks which are attached to the fork carriage assembly of the linkage system.

Advantageously in this aspect of the invention, the linkage system controls the angle of the load carrying means relative to the upright fork mast which houses the channel of the linkage system as the load carrying means moves between a retracted and extended position.

A further advantage is realised by the ability to fully retract the linkage system to within the confines of the channel thus reducing any overhang of the system.

In a further aspect of the invention, any one of the links of the linkage system are optionally provided with an adjustable length at either end to account for manufacturing deviations or alternatively to enable an operator to adjust the tilt setting of the load carrying means.

It is understood that the term reach system means a system that is suitable for altering the reach of a load carrying means such as for example, moving mast systems, telescopic forks or pantograph linkage arrangements. In a further aspect, the reach system is provided with load carrying means wherein the load carrying means are any one of stand alone detachable or adjustable forks, welded forks or alternatively a fork carriage having forks or tines attached thereto.

In a further aspect of the invention, the main forklift mast is provided with a vertically aligned roller stabilisation system to allow side shift of the entire mast while the forks are bearing a load. Single or multiple rollers can be used as required or any other components that will allow a sliding motion of the mast under load. Conventional non sliding supports can also be used if mast sideshifting is not required or if an integrated fork carriage sideshift is used.

It is understood that conventional wheel stabilisation mechanisms could also be used with the linkage system of the invention.

It is also understood that although the linkage system of the invention and roller stabilisation system are described above with reference to a single component system. It is also understood that in practicable application the components of these systems can be increased as desired and that the increased number of components can by connected by various cross members, pins and so forth as required by a person skilled in the art.

Further aspects of the present invention will become apparent from the ensuing description which is given by way of example only.

BRIEF DESCRIPTION OF THE DRAWINGS

The invention will now be described more particularly with reference to the accompanying drawings, which show by way of example only various embodiments of the invention.

In the drawings.

DESCRIPTION OF PREFERRED EMBODIMENTS

Figure 1:
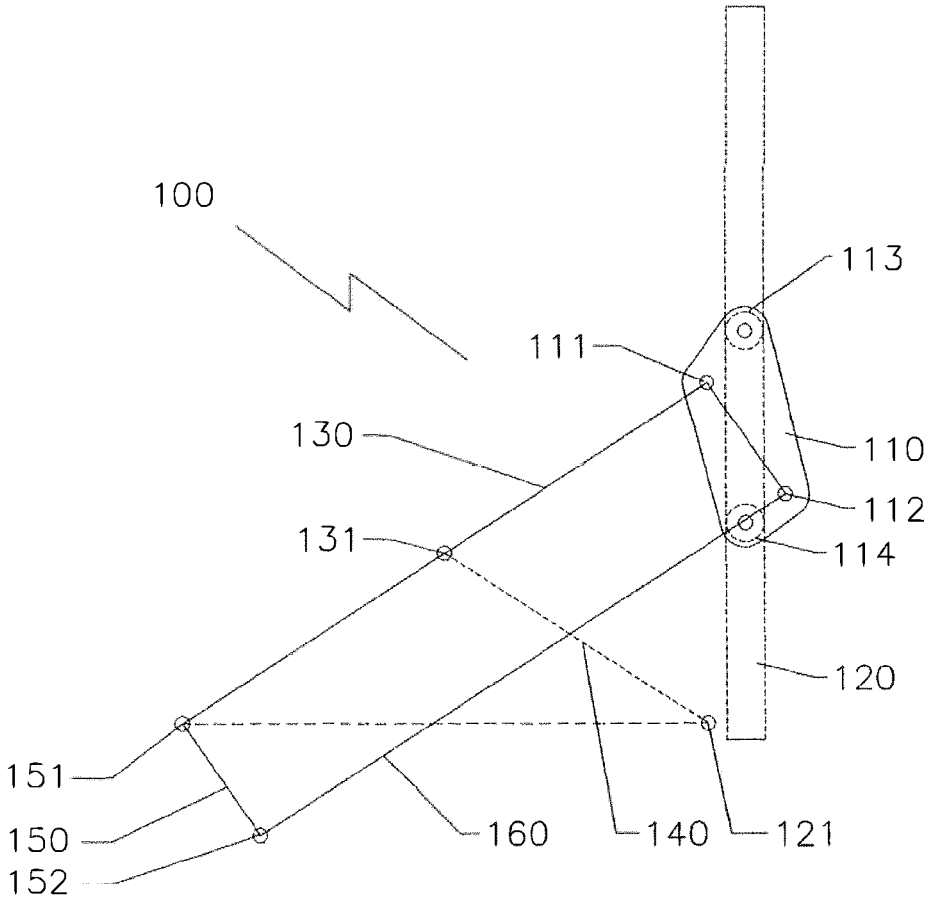
FIGS. 1 to 4 show movement of points on the linkage system of the invention across a horizontal plane from an extended position to a retracted position.

Referring now to the drawings and specifically to FIGS. 1 to 7, there is shown a linkage system denoted generally by the reference numeral 100 which is suitable for use with any forklift truck and specifically the kind labelled 300 in FIGS. 9 to 12.

Figure 9:
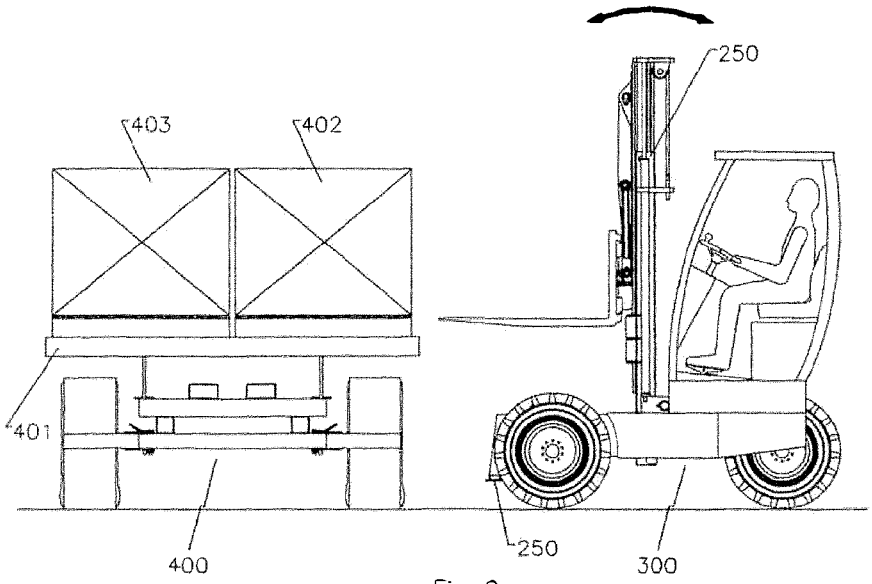
FIGS. 9 and 10 are side views of an unloading sequence using the linkage system of the invention attached to a straddle type forklift truck when removing a load from a first position on a raised surface.
Figure 10:
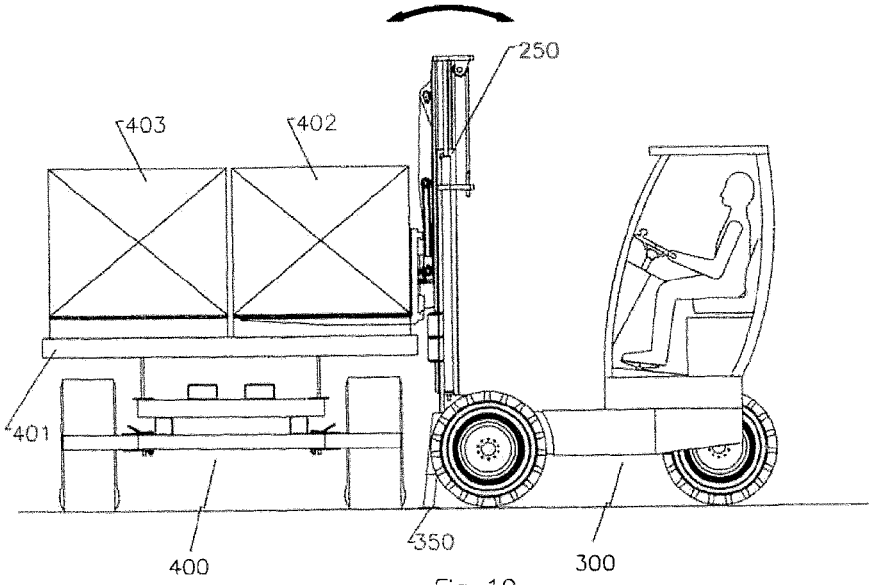
Figure 11:
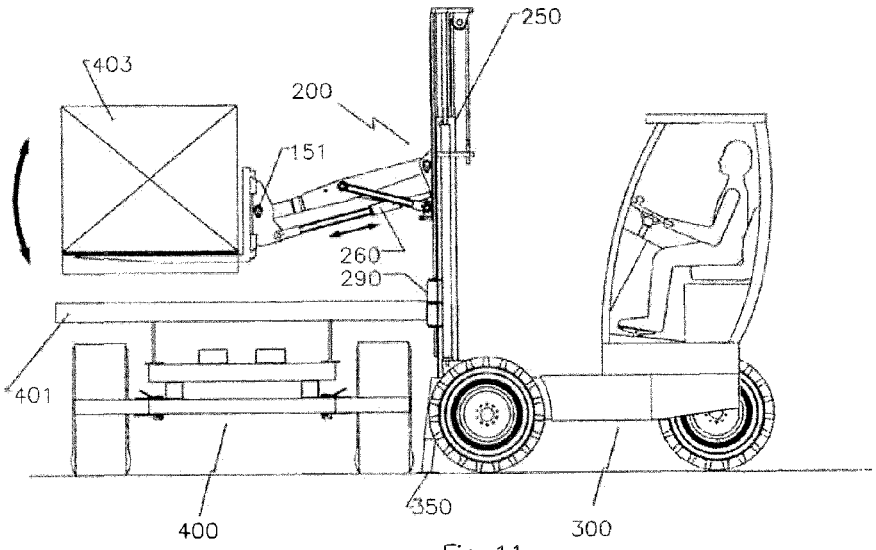
FIGS. 11 and 12 are side views of an unloading sequence using the linkage system of the invention attached to a straddle type forklift truck when removing a load from a second position on a raised surface.
Figure 12:
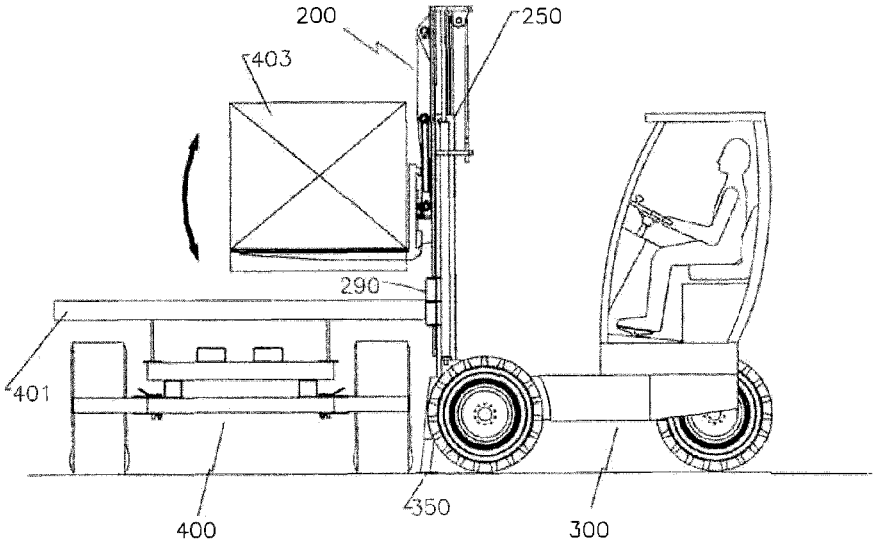

Forklift truck 300 is type of forklift truck known as a truck mounted forklift truck. It is understood that the linkage system of the invention is not limited to use with this type of forklift truck. The linkage system of the invention is suitable for use with any forklift truck known to a person skilled in the art. The forklift 100 is a straddle frame design and employing an upright lifting mast 250 in which the linkage system 100 or 200 is incorporated. The forklift version shown uses a double reach system. The lift mast 250 firstly extends forward on a vertically captive roller or slider system to engage a load 402 in close proximity to the front wheels of the forklift as shown in FIGS. 9 and 10. When engaging a load 403 requiring extended reach, the secondary reach system 100 or 200 is also extended as shown in FIGS. 11 and 12.

Although not shown, it is understood that adjustable forks, a fork positioning means and side shift mechanisms are easily incorporated into overall design of the forklift truck or reach mechanism as desired.

Figure 5:
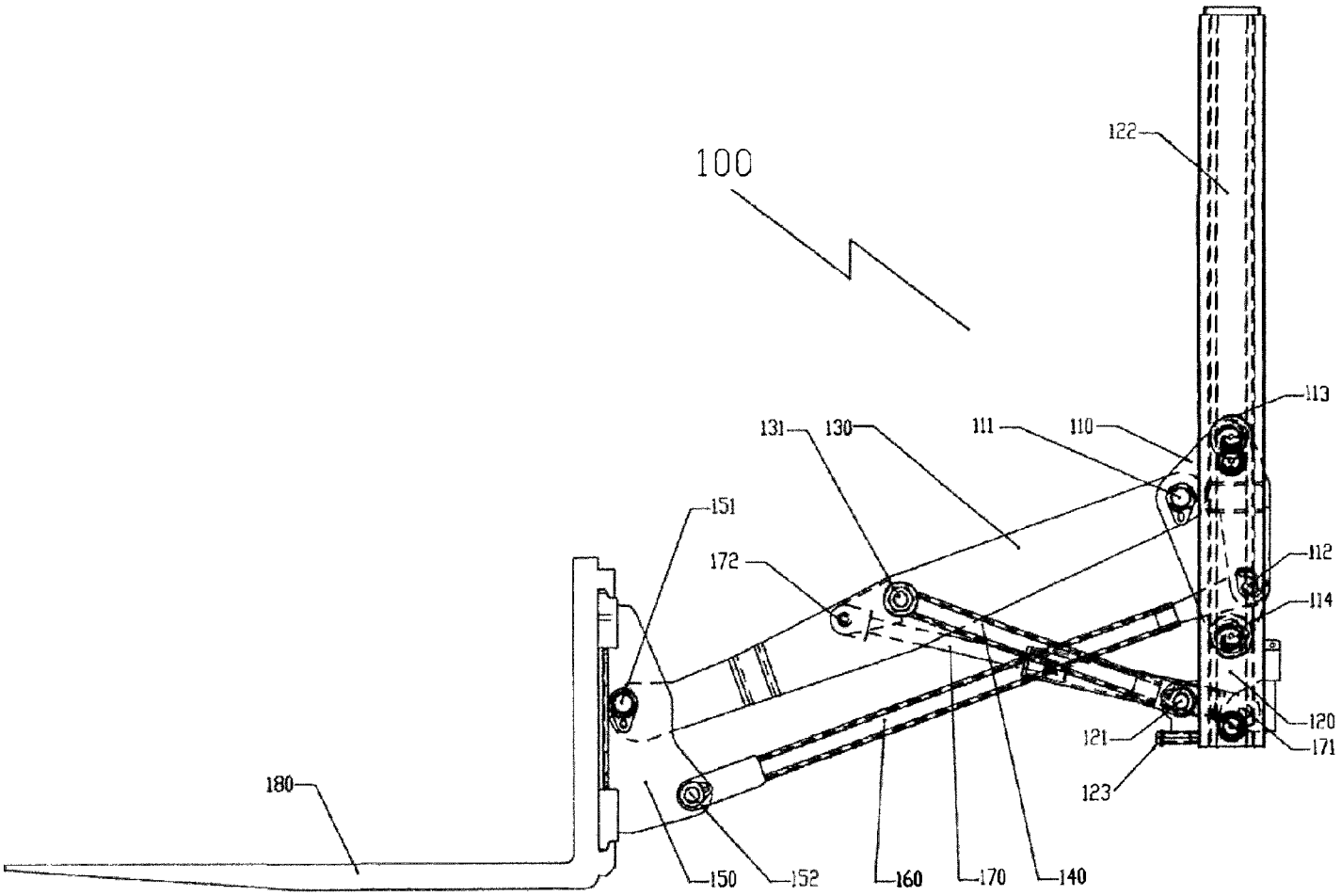
FIG. 5 is a side view of the linkage system of the invention attached to load carrying means in an extended position.
Figure 6:
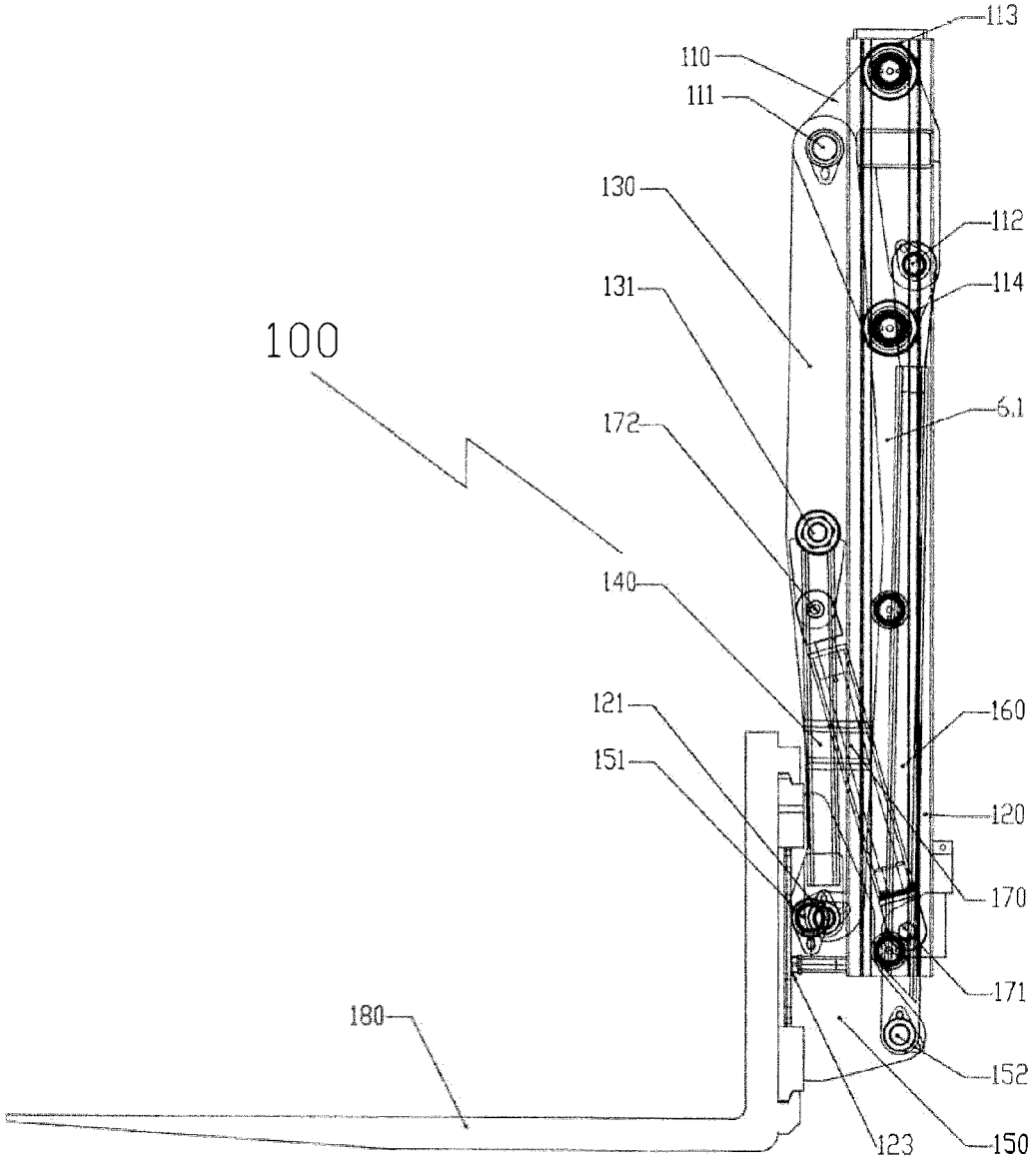
FIG. 6 is a side view of the linkage system of the invention attached to load carrying means in a retracted position.
Figure 7:
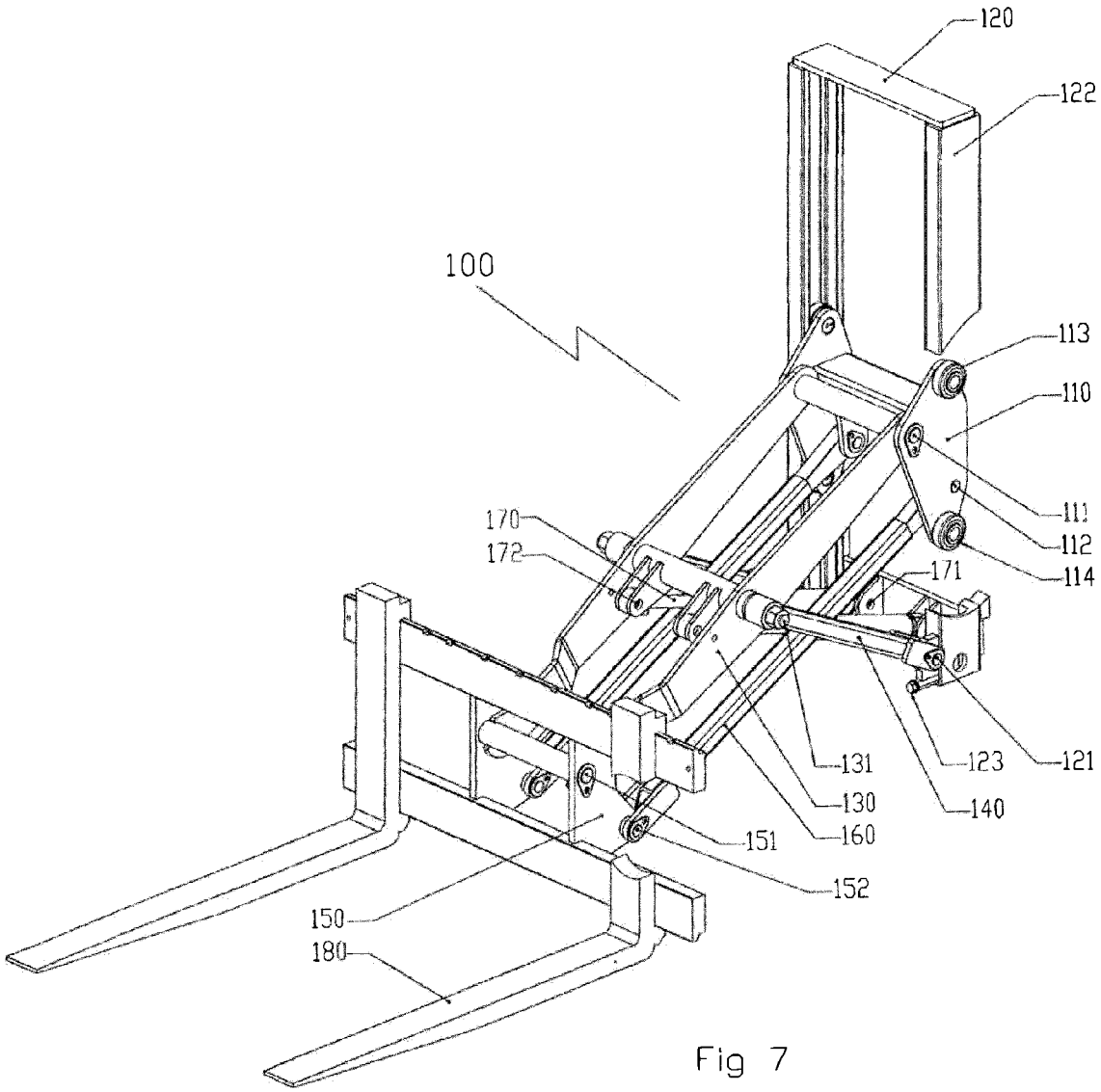
FIG. 7 is a perspective view of the linkage system of the invention in an extended position with a section of fork and channel section cut away to show hidden parts.
Figure 8:
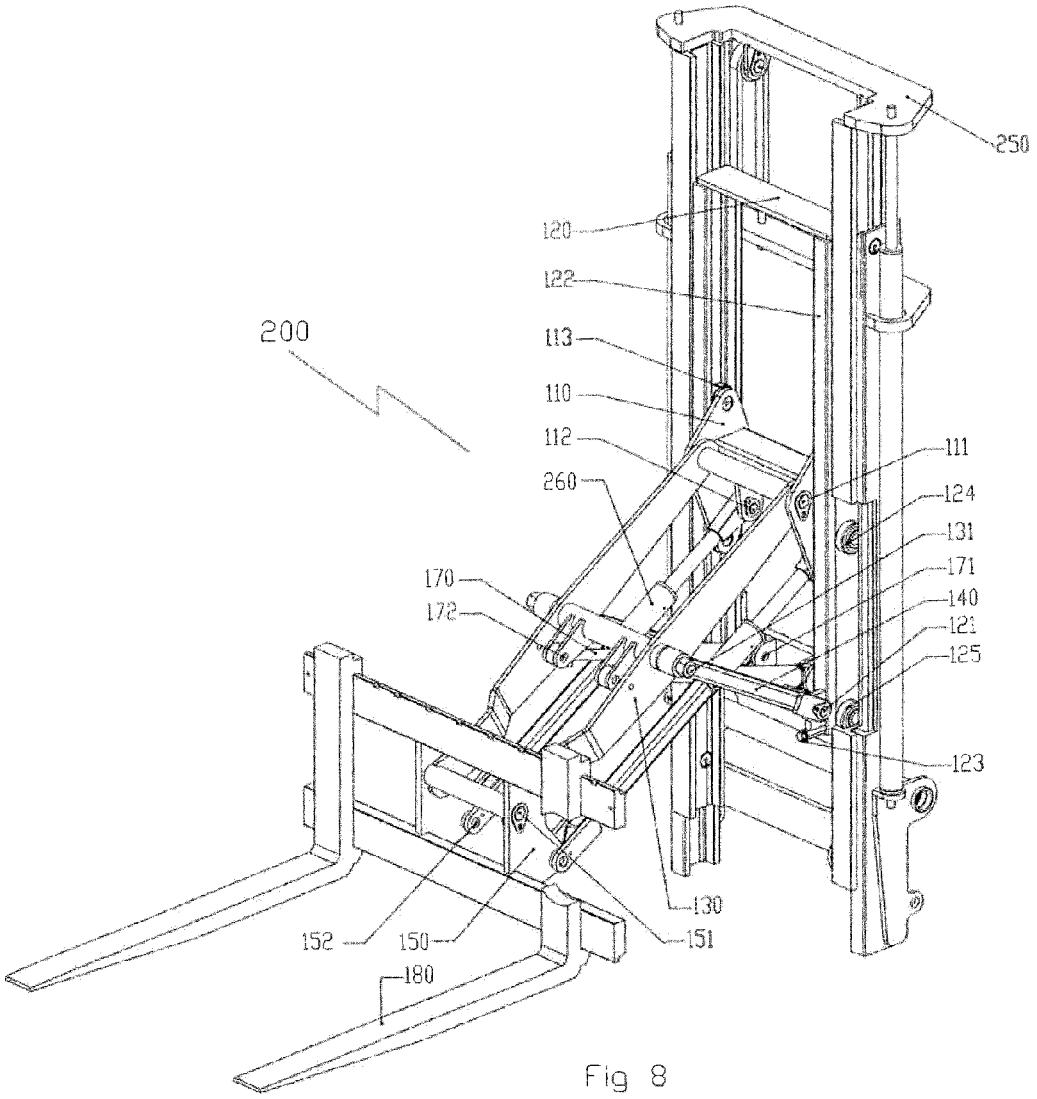
FIG. 8 is a perspective view of an alternative linkage system of the invention attached to a duplex forklift lift mast with a section of mast cut away to show hidden parts.

Referring to FIGS. 5 to 7, there are shown in these drawings perspective views of the linkage system 100 in the extended and retracted positions. When incorporated into a forklift mast 250, the fork carriage 150 will be fitted with forks 180 or other suitable load carrying means. When rear section assembly 120 is in a vertical position the linkage system 100 moves the load carrying means in a generally horizontal position. FIG. 8 shows the mounting of the linkage system 100 or 200 in a standard Duplex mast. Cut away sections on the main mast allow view of the mounting roller bearings 124 and 125 which are horizontally captive in the main mast channels but free to move vertically along the channels via lift chains and lift cylinders.

The linkage system 100 in its basic form comprises of several assembled parts. Referring mainly to FIGS. 5 to 7, a levelling carriage assembly 110 is mounted to channel assembly 120 by roller bearings 113 and 114 so that it is held captive and can only move in a general vertical orientation along the channel assembly. Single or multiple wear pads can also be used instead of roller bearings. A main long link 130 is pivotally connected at one end to the leveling carriage assembly 110 at point 111 and pivotally connected to short link 140 at point 131 which is approximately midway along link 130. This short link 140 is in turn pivotally connected to rear channel assembly 120 at point 121. Main long link 130 is additionally pivotally connected to fork carriage assembly 150 at point 151. Fork carriage assembly 150 is additionally pivotally connected to a levelling link 160 at point 152. The other end of levelling link 160 is pivotally connected to the levelling carriage assembly 110 at point 112. Movement of the linkage system 100 is actuated by hydraulic rams 170 which are pivotally connected to channel assembly 120 at point 171 and to first main long link 130 at pivot point 172.

In an alternative arrangement, rams 170 can be mounted at any suitable position on the main long link 130 or indeed on the short link 140. It is also possible to mount ram 170 directly between main long link 130 and short link 140. It is understood that any number of rams can be used as required by the person skilled in the art. Fork arms 180 or other suitable load carrying means are mounted on fork carriage assembly 150 in a conventional manner.

In this embodiment of the linkage system 100, the distance from point 111 to point 131 is substantially equal to the distance from point 131 to point 151 and point 131 to point 121. Similarly, the distance from point 111 to point 151 is substantially equal to the distance from point 112 to point 152. In addition, the distance between and orientation of point 111 and point 112 is substantially similar to the distance between and orientation of point 151 and point 152. The linkage configuration forms an ever changing sliding parallelogram which in combination with the other links keeps the forks or load carrying means substantially level whilst moving from an extended to retracted position.

Figure 2:
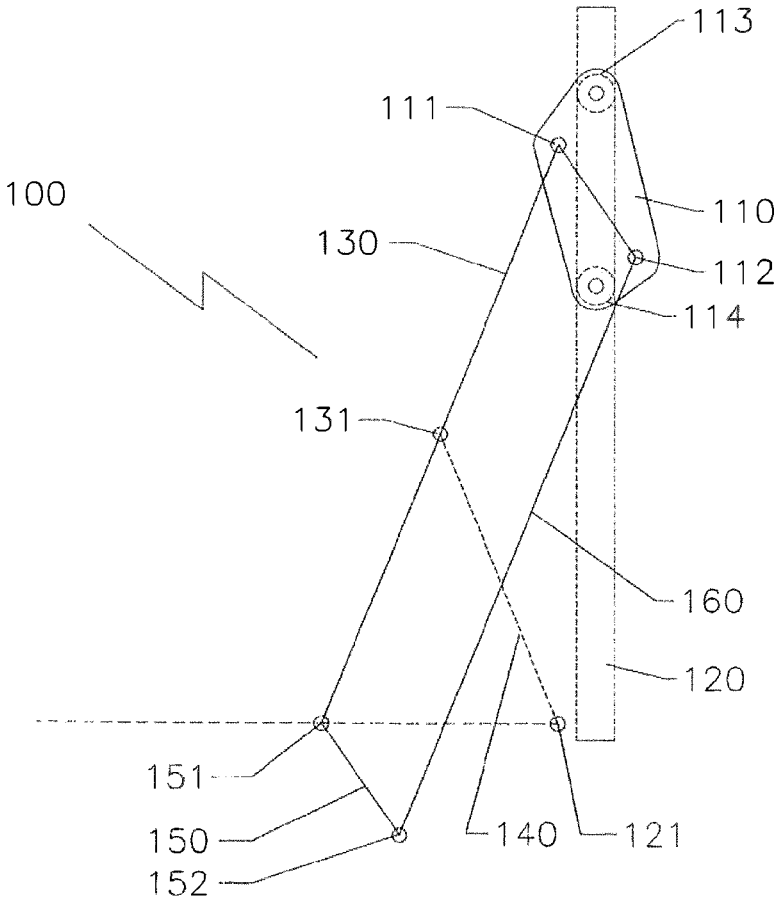
Figure 3:
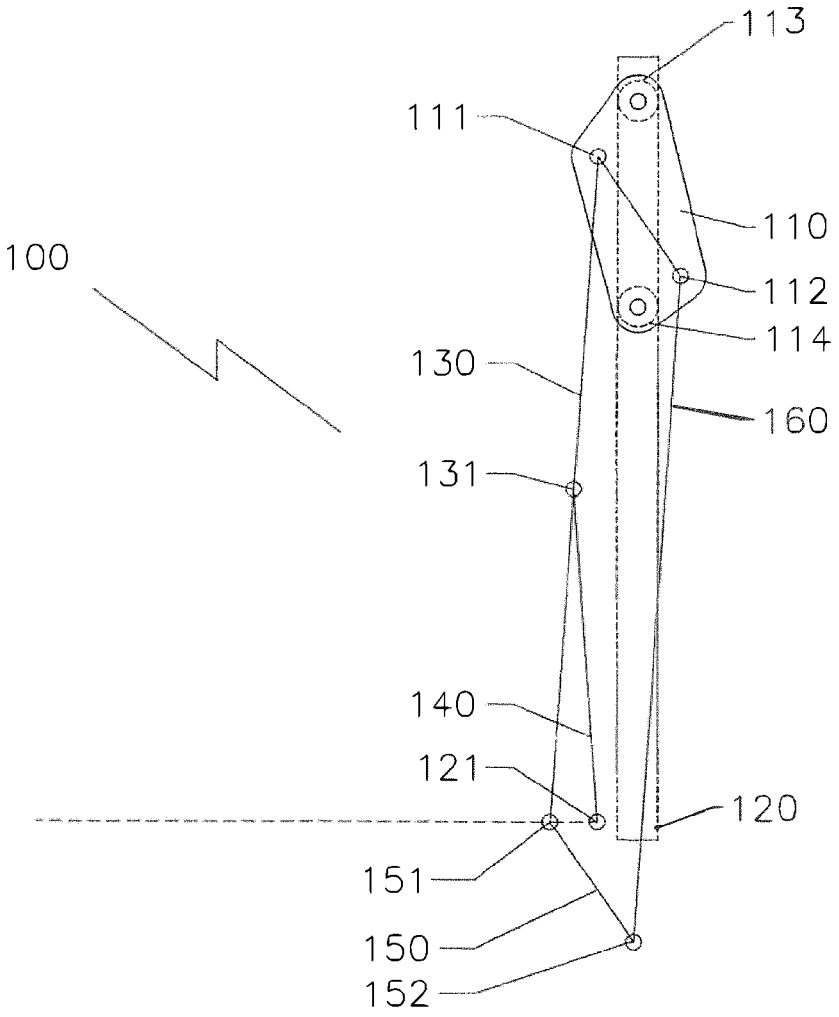
Figure 4:
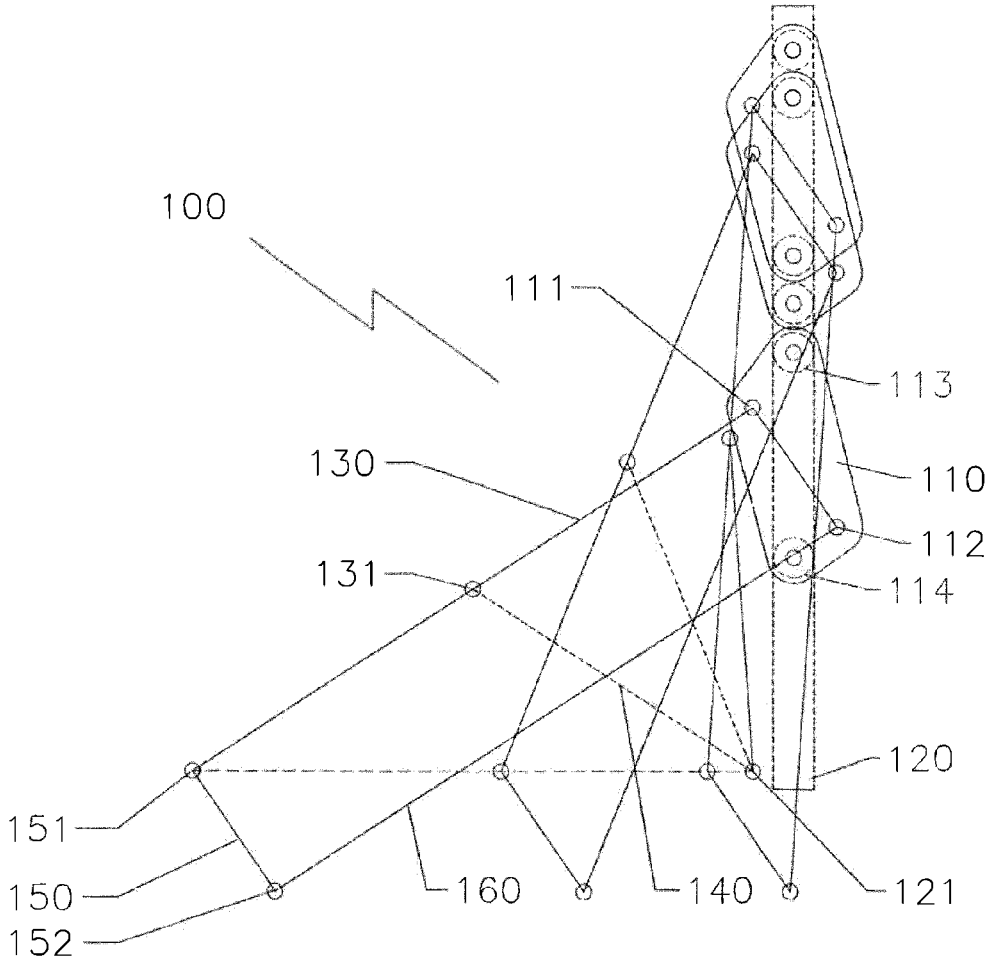

The movement of linkage system 100 is shown in line diagram form in FIGS. 1 to 4. The hydraulic ram 170 is not shown in these drawings to aid clarity. FIG. 1 shows the linkage system in the extended position. As main long link 130 is retracted, pivotally connected levelling carriage assembly 110 slides upward along the captive channels of channel assembly 120. In addition, levelling link 160 maintains its parallelogram connection between the levelling carriage assembly 110 and fork carriage assembly 150 and in turn keeps the fork carriage assembly angle substantially constant to the rear channel assembly 120. FIG. 2 shows the linkage in an intermediate location and FIG. 3 shows the linkage fully retracted. FIG. 4 is an amalgamation of the points of movement shown in FIGS. 1 to 3 permitted by the linkage system 100.

Figure 13:
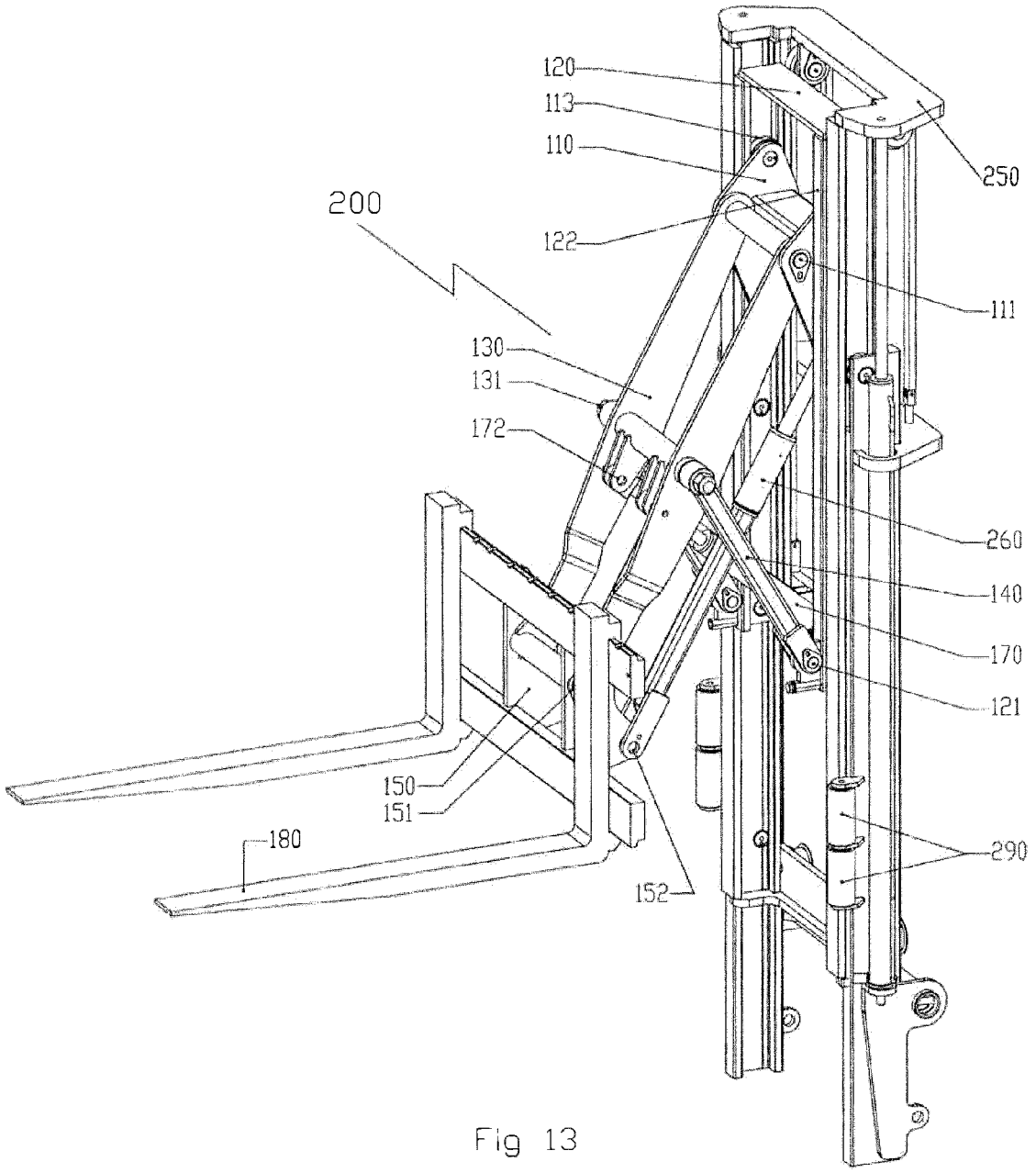
FIG. 13 is a perspective view of an alternative linkage system of the invention attached to a duplex forklift lift mast fitted with additional roller stabilisation system.

FIGS. 8, 11, 12 and 13 show another embodiment of linkage system 100. Whilst linkage system 100 maintains a constant fork carriage angle, a second embodiment linkage system 200 has the ability to tilt the fork carriage assembly by replacing levelling link 160 with hydraulic ram link arms 260. Extension of the hydraulic ram link 260 will force fork carriage assembly 150 to tilt upwards without movement of main long link 130 or channel assembly 120. The stroke of tilt ram link arm 260 can be designed to give a maximum amount of tilt forwards and rewards as desired. It is advantageous to tilt at or near the fork carriage so there is no magnification of tilt moment when the reach is extended resulting in reduced stresses and improved controllability. This feature is particularly advantageous when unloading a trailer from one side only as shown in FIGS. 11 to 13.

Truck mounted forklifts are carried on the rear of a trailer in-between deliveries and therefore need to be as light as possible. For this reason a straddle design is used so that the forklift has a high lift capacity compared to the unladen forklift weight. In normal operation, the forklift 300 extends the primary reach system to engage the load 402 and then lowers the stabilisers 350 as shown in FIGS. 9 and 10. The forklift is designed to have enough stability with the stabilisers lowered to lift the maximum rated capacity safely and then retract the primary reach which brings the combined centre of gravity towards the centre of a forklift. The stabilisers can then be elevated and the forklift can drive away with the load. FIG. 11 shows forklift 300 with both the primary reach and secondary reach extended. Load 403 is positioned at the other side of the trailer and is at a much larger load centre. In a regular configuration forklift 300 would have a much reduced lift capacity in this extended position. However FIG. 13 shows lift mast 250 fitted with vertically aligned stability rollers 290. These stability rollers 290 can be seen again in FIGS. 11 and 12 during a one side offloading sequence. In order to increase the lift capacity when lifting from the far side of the trailer, the lift mast 250 can be rested against the side of the trailer bed 401 via stability rollers 290. The trailer bed 401 is used as an anchor which gives much increased stability. The stability rollers 290 allow the lift mast 250 to sideshift whilst still maintaining stability; however the conventional tilting of mast 250 (the entire mast tilts) cannot be used during this operation as this would cause the forklift 300 to become unstable and lose contact with the trailer bed 401. For this reason the independent tilting of the fork carriage as described in alternative embodiment 200 above, is most advantageous as the load 403 can be lifted from the far side of the trailer and tilted without any loss of stability.

Figure 14:
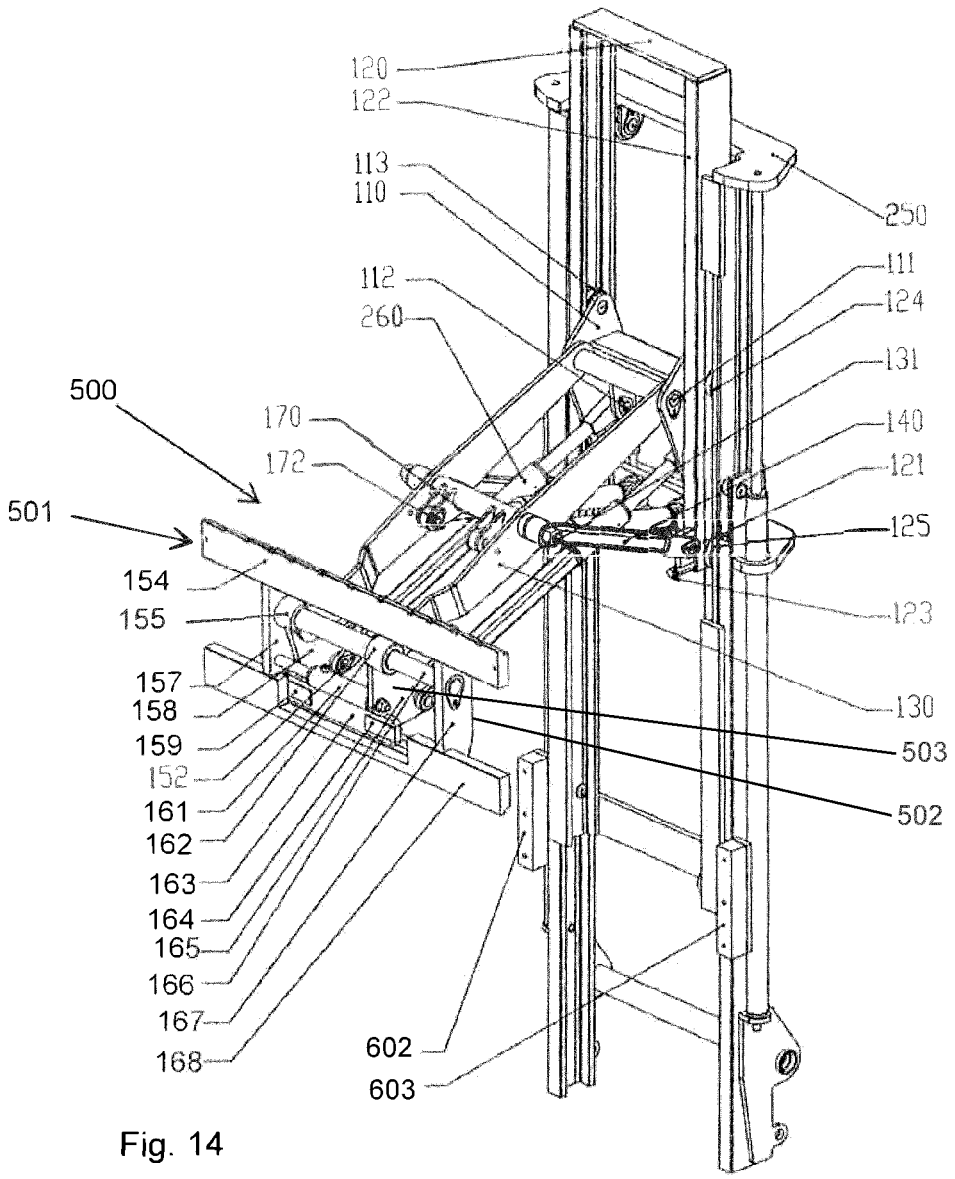
FIG. 14 is a perspective view from the front of a fork carriage mounted side shift system.
Figure 15:
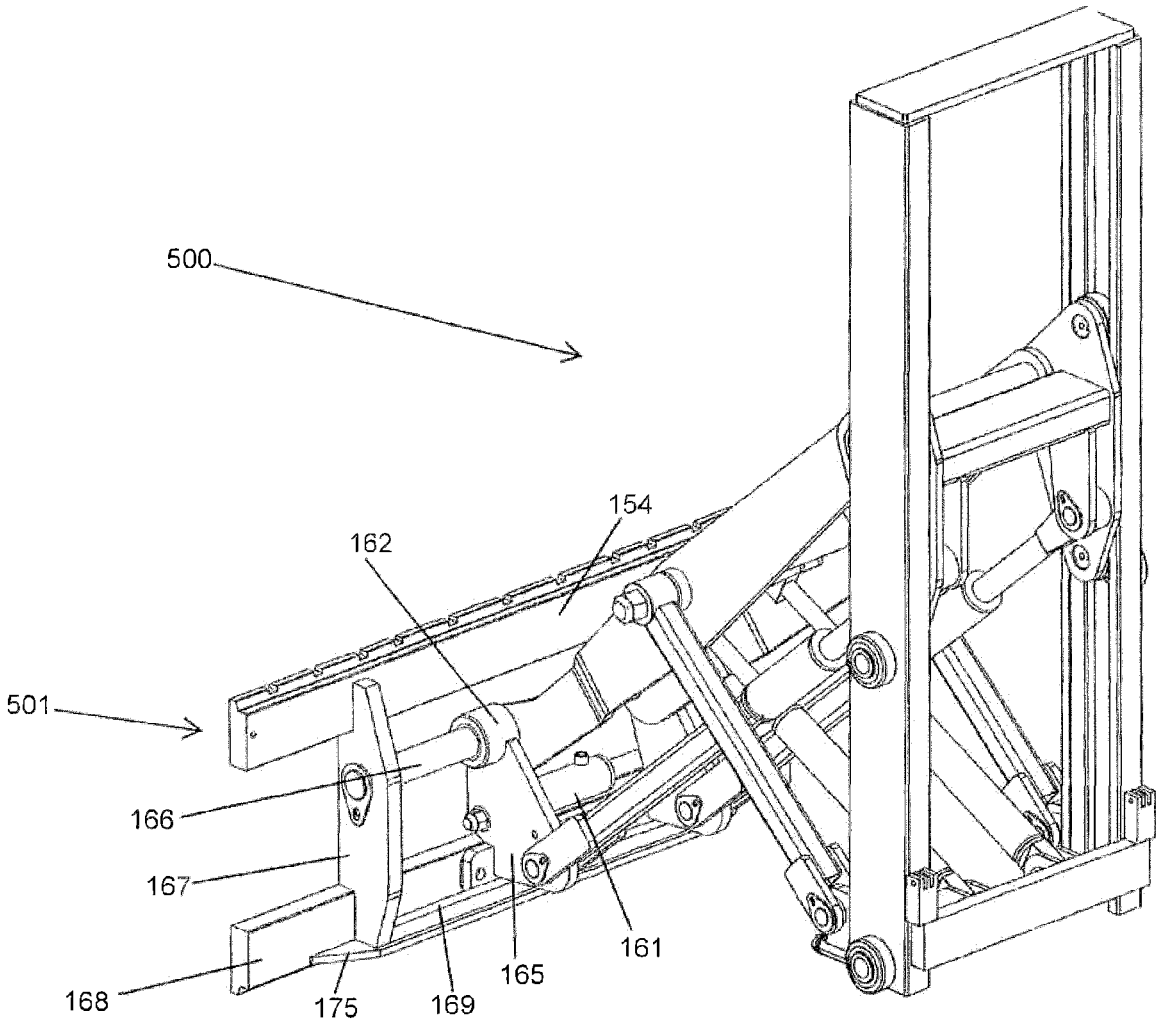
FIG. 15 is a perspective view from the rear of the fork carriage mounted side shift system.

Referring to FIGS. 14 and 15, an integrated side shift system 500 is included in a further embodiment of a forklift linkage system according to the invention. Like parts to other embodiments are given like numerals, in particular the tilting version embodiment are given like numerals. The main distinction of the integrated side shift system 500 is that the fork carriage assembly 501 allows lateral movement from side to side as required in various loading conditions during loading and unloading of loads. The forks of the fork carriage assembly 501 are not shown for clarity purposes, but they are the same as in the other embodiments.

The main components of the fork carriage assembly 501 are fork support carriage 502, connection assembly 503 and side shift cylinder 161. Fork support carriage 502 includes an upper fork support board 154 and the lower fork support board 168 connected together by a first support plate 157 and a second support plate 167. Between the plates 157 and 167 is the main pivot shaft 166 for the reach system which also acts as the sliding member for the side shift action.

Main pivot shaft 166 is also connected to connection assembly 503 through the main support bosses 155 and 162 which are mounted on the main support plates 158 and 165 which are connected by lower support plate 163. The movement of the side shift is controlled by a hydraulic cylinder 161 mounted between the fork support carriage 502 on support plate 157 and on connection assembly 503 on main support plate 165. A portion of the lower fork support board 168 is shown cut away in FIG. 14 for illustration purposes to allow visibility of wear pads 159 and 164 mounted on lower support plate 163. To prevent the wear pads 159 and 164 from falling out as a result of negative tilt on fork support carriage 502, a stop 169 is fixed to a gusset plate 175 at the rear of the fork support carriage 501 as shown in FIG. 15.

Also provided in this embodiment are two trailer rest pads 602 and 603 mounted on the mast in place of the rollers 290. This is because the side shift is independent of the mast in the integrated sideshift system. The trailer rest pads will rest against the trailer during loading and unloading of the trailer from the far side. The unloading procedure works in the same way as shown in FIGS. 9, 10, 11 and 12 except that the mast does not sideshift but remains stationary with the trailer.

For the purposes of clarity, the description of linkage systems and stability roller system above references components mainly as single parts. However, in practicable application of these systems most components are duplicated and connected by various cross members, pins etc, many of which can be identified in perspective views FIGS. 5 to 8 and FIG. 13. In addition, the layering of the links can be arranged in many different ways. It is understood that linkage system 100 or 200 components can be arranged in any sequence to achieve the same movement. It is also understood that although the linkage system 100 and 200 is described with reference to rollers 113 and 114 any other movable means which allows a sliding movement within channel 122 can be used for example a wear pad arrangement.

Although not shown it is understood that an adjustable length link can be provided at either end of the arms or linkage components to account for manufacturing deviations or alternatively to enable an operator to adjust the tilt setting of the load carrying means.

It is understood that any suitable type of load carrying means can be attached onto any type of fork carriage that enable pivot points 151 and 152 to be fitted as required. Various types of fork positioner, side shift or wheel stabilisation mechanism can be incorporated for use with the linkage systems 100 or 200.

It will of course be understood that the invention is not limited to the specific details described herein, which are given by way of example only, and that various modifications and alterations are possible within the scope of the invention as defined in the attached claims.

The invention claimed is:

1. A forklift linkage system for movement, comprising:

a levelling carriage assembly movably contained within a channel assembly;

a main long link pivotally connected to the levelling carriage assembly at a first pivot point and a fork carriage assembly at a second pivot point;

a short link pivotally connected substantially near a midpoint of the main long link at a third pivot point and at a fixed pivot point relative to the channel, substantially near a vertical offset position from the pivot point of the main long link to the levelling carriage assembly at a fourth pivot point; and a levelling link pivotally connected to the levelling carriage assembly at a fifth pivot point and at the opposite end to the fork carriage assembly at a sixth pivot point, such that the travel path of the second pivot point connecting the main long link to the fork carriage assembly remains substantially perpendicular to the channel when the linkage system is moved between a retracted and extended position and the angle through the second pivot point connecting the main long link to the fork carriage assembly and the sixth pivot point connecting the levelling link to the fork carriage assembly remains substantially constant in relation to the channel when the linkage system is moved between a retracted and extended position.

2. The forklift linkage system as claimed in claim 1, in which movement of the linkage system is occasioned by the application of force to the linkage system and in which the force is applied by at least one actuator.

3. The forklift linkage system as claimed in claim 2, in which one end of the at least one actuator is pivotally connected to the main long link and the other end of the actuator is connected to a fixed location on the channel assembly.

4. The forklift linkage system as claimed in claim 2, in which the at least one actuator is pivotally connected to the levelling carriage assembly, channel assembly, main long link or short link or any combination thereof.

5. The forklift linkage system as claimed in claim 2, in which the force applied by the at least one actuator is a translational movement in which the actuator forces the levelling carriage assembly to move in a first plane within the channel, thereby moving the main long link and consequently forcing the fork carriage assembly to move along a second plane which is substantially perpendicular to the first plane.

6. The forklift linkage system as claimed in claim 1, in which the leveling link of the linkage system is a link arm or either a hydraulic or electrical ram which enables the linkage system to provide an independent tilt mechanism, whereby in operation the fork carriage assembly pivots about the pivot point connecting the main long link, so that the reach of the fork carriage assembly is extended without magnification of the tilt moment as the reach is extended from an upright fork mast, thereby enabling the linkage system to compensate for a load's tendency to angle the fork carriage assembly toward the ground, which in turn reduces the risk of slippage of a load from the fork carriage assembly.

7. The forklift linkage system as claimed in claim 1, in which the distance between the pivot points on the main long link, that is, the distance between the pivot point connecting the levelling carriage assembly to the main long link and the pivot point connecting the short link to the main long link is substantially equal to the distance between the pivot point connecting the short link to the main long link and the fork carriage assembly to the main long link are substantially equal.

8. The forklift linkage system as claimed in claim 1, in which the distance between the pivot point connecting the short link to the main long link and the pivot point connecting the short link to the channel assembly is substantially equal to either of the distances between the pivot point connecting the levelling carriage assembly to the main long link and the pivot point connecting the short link to the main long link or the pivot point connecting the short link to the main long link and the fork carriage assembly to the main long link.

9. The forklift linkage system as claimed in claim 1, in which the pivot point connecting the levelling carriage assembly to the main long link and the pivot point connecting the main long link to the fork carriage assembly is substantially equal to the pivot point connecting the levelling link to the fork carriage and the pivot point connecting the levelling link to the levelling carriage assembly.

10. The forklift linkage system as claimed in claim 1, in which the distance between and orientation of the two pivot points connecting the links on the fork carriage assembly are substantially similar to those connecting the links on the levelling carriage assembly.

11. The forklift linkage system as claimed in claim 1, further comprising a fork carriage mounted sideshifter.

12. The forklift linkage system as claimed in claim 1, further comprising an integrated sideshifter.

13. The fork lift linkage system as claimed in claim 11, in which means are provided for allowing the fork carriage assembly to move latterly from side to side as required in various loading and unloading conditions, the fork support carriage comprising an upper fork support board and a lower fork support board, connected together by a first support plate and a second support plate between which is mounted a main pivot shaft for the reach system and which also acts as a sliding member for the side shift action and is connected to a connection assembly through a pair of main support bosses mounted on the support plates, with movement of the side shift being controlled by an actuator mounted between the fork support carriage and the connection assembly on the support plates, and one or more wear plates are provided for sliding contact with the lower fork support board.

14. The forklift linkage system as claimed in claim 1, in which the linkage system is adapted for use with a material handling device and a load carrier is attached to the fork carriage assembly of the linkage system.

15. The forklift linkage system as claimed in claim 14, in which the fork carriage assembly comprises at least one component to which the main long link and levelling link are pivotally connected.

16. The forklift linkage system as claimed in claim 2, in which the at least one actuator comprises a rod or a hydraulic or electrical ram.

17. The forklift linkage system as claimed in claim 1, in which the levelling carriage assembly comprises components that are movable between a first and second position within the channel assembly, with such components including a sliding mechanism or a rolling component.

18. The forklift linkage system as claimed claim 1, in which the channel assembly is movably or slidably attached to an upright member such as an upright mast of a forklift truck.

19. The forklift linkage system as claimed in claim 1, which is provided on a forklift truck.

20. The forklift linkage system as claimed in claim 19, in which the forklift truck is adapted to be mounted on a carrying vehicle, and the fork carriage assembly comprises a fork carriage and forks which are attached to the fork carriage assembly of the linkage system.

21. The forklift linkage system as claimed claim 1, in which the linkage system controls the angle of the fork carriage assembly relative to an upright fork mast which houses the channel of the linkage system as the fork carriage assembly moves between retracted and extended positions.

22. The forklift linkage system as claimed in claim 1, wherein the linkage system is retractable for reducing any overhang of the system.

23. The forklift linkage system as claimed in claim 1, in which any one of the links of the linkage system are optionally provided with an adjustable length at either end to account for manufacturing deviations or alternatively to enable an operator to adjust a tilt setting of the fork carriage assembly.

24. The forklift linkage system as claimed in claim 1, in which a reach system is provided with the fork carriage assembly wherein the fork carriage assembly are any one of stand alone detachable or adjustable forks, welded forks or alternatively a fork carriage having forks or tines attached thereto.

25. The forklift linkage system as claimed in claim 21, in which the upright fork mast is provided with a vertically aligned roller stabilisation system to allow side shift of the entire mast while forks are bearing a load, said roller stabilisation system comprising single or multiple rollers or any other components that allow a sliding motion of the mast under load.

* * * * *